United States Patent [19]

Hoffmann et al.

[11] Patent Number: 4,549,488

[45] Date of Patent: Oct. 29, 1985

[54] PROJECTILE HAVING A TUBULAR BODY

[75] Inventors: Dietrich Hoffmann, Schramberg; Udo Gotz, Trossingen, both of Fed. Rep. of Germany

[73] Assignee: Mauser-Werke Oberndorf GmbH, Fed. Rep. of Germany

[21] Appl. No.: 553,190

[22] Filed: Nov. 18, 1983

[30] Foreign Application Priority Data

Nov. 24, 1982 [DE] Fed. Rep. of Germany ..... 3243430

[51] Int. Cl.[4] ..... F42B 13/00; F42B 13/16

[52] U.S. Cl. ..... 102/503; 102/522

[58] Field of Search ..... 102/501, 503, 515–519, 102/520–523

[56] References Cited

U.S. PATENT DOCUMENTS

| | | | |
|---|---|---|---|
| 3,164,092 | 1/1965 | Reed et al. | 102/522 |
| 3,938,442 | 2/1976 | Donadio | 102/703 |

FOREIGN PATENT DOCUMENTS

| | | | |
|---|---|---|---|
| 2753633 | 6/1978 | Fed. Rep. of Germany . | |
| 2831574 | 2/1979 | Fed. Rep. of Germany . | |
| 2757665 | 6/1979 | Fed. Rep. of Germany . | |
| 125603 | 5/1919 | United Kingdom | 102/501 |

*Primary Examiner*—Harold J. Tudor

[57] ABSTRACT

A projectile comprises a tubular body and a sabot or impact base connected to the rear portion. The tubular body is connected to the sabot by radially extending pins, and the rear face of the body is spaced from a circular shoulder of the sabot by a distance equal to, or larger than, the diameter of the pins. To ensure a transfer of the spin of the sabot to the body, the rear face of the body is provided with a corrugation, such as teeth, or a knurling, which, at the discharge and after the pins are sheared off, digs into the surface of the circular shoulder.

2 Claims, 9 Drawing Figures

PROJECTILE HAVING A TUBULAR BODY

FIELD AND BACKGROUND OF THE INVENTION

This invention relates in general to the construction of projectiles and in particular to a new and useful projectile having a tubular body which is connected to an impact base.

German OS No. 27 53 633 discloses a projectile to be fired at a supersonic velocity, comprising a tubular body having a substantially circular cross section, an inlet opening in the front, an outlet opening in the rear, and a central bore extending therebetween. Connected to the rear portion is a drive member with a sabot ring. The sabot ring is detached after the discharge by centrifugal forces. Due to the dynamic pressure built up in the interior of the projectile, the drive member is then pushed away therefrom. Since the sabot ring must be adjusted, the tubular body must be fitted to the drive member, and an annular lip must be provided serving as a gas seal during the firing, the projectile is relatively expensive and requires many accurately machined parts.

Further, the inwardly protruding rear portion of the tubular body produces an unfavorable effect on the flow conditions about the projectile.

In the projectiles with a tubular body, the so called tube projectiles, the aerodynamic flow conditions are of primary importance. A smooth flow along the body in the supersonic region is obtained only if constructional elements are provided which do not cause turbulence.

SUMMARY OF THE INVENTION

The invention is directed to a tubular body which can be fired at velocities in the upper supersonic range, is simple in design and produces optimum flow conditions.

In accordance with the invention, a projectile comprises a tubular projectile body having a rear portion which is connected to an impact base which has a forward portion connected to the rear portion and has an exterior surface with an annular groove with a rotating band in the groove. The projectile body is of a size formable to the forward portion of the impact base and for example engages snugly over the forward end of the base. The two parts are positively locked together by interrengageable elements such as a shearing pin, flange or the like. Preferably the rear face of the projectile body is spaced away from a raised circular shoulder of the impact base. The rear face and the circular shoulder are spaced from each other by an axial distance which is preferably equal to or larger than the diameter of the shearing pins. The shearing pins include one or more, for example, four equally circumferentially spaced pins which extend through the projectile body and into accommodating bores of the impact base.

Advantageously, the rear face of the projectile body is provided with a corrugation or knurling or teeth formations which engage into the circular shoulder of the impact base after the pins are sheared so that the impact body imparts a spinning rotation to the projectile. Advantageously the material of the projectile body is harder than that of the impact base. The impact base may be made of a plastic material.

To obtain the required effect, the projectile is fired by means of a sabot which is connected to the tubular body in the most simple way. Depending on the rifling, the provided axial spacing may be omitted, and the pins are then sheared off under the effect of rotary acceleration. The sabot carries the rotating band and is provided with an engagement groove for the charge case.

This makes it possible to employ conventional propellant cases and to provide the usual method of connecting the shell to the case. Advantageously, the sabot may be of such shape that the tubular shell body remains cylindrical in its rear portion, i.e. the wall thickness thereof does not change. The tubular shell body is connected to the sabot through radially engaged pins ensuring a satisfactory handling and loading of the projectile. At the discharge, the pins are sheared off, so that the tubular body can butt against the circular shoulder of the sabot. With a sufficient spin, the pins are sheared off due to the unequal taking up of the spin by the sabot and the tubular body. Advantageously, and in a simple way, the spin is transferred from the sabot to the tubular body through a corrugation provided on the rear face of the tubular body. As the projectile is fired, the tubular body impinges on the sabot, with the corrugated rear face penetrating into the opposite softer shoulder, thus ensuring a transmission of the spin.

In a preferred construction of the invention, the impact base or sabot is made of a plastic material and has its forward portion formed integrally with radial pins which extend outwardly and engage into bores provided in the projectile body.

The so-called tube projectiles are relatively very stable. Conventional barrels, which are not specially designed for tube projectiles, would therefore impart to such a projectile a spin by far exceeding the rotation needed for stabilization. That is why it is advantageous to partly reduce the spin transfer, so as not to unfavorably affect the aerodynamic and ballistic conditions.

To enlarge the space for the charge, and also to reduce the masses to be accelerated, the sabot may be provided in its rear with a blind bore. Further, a hood or ogive provided with rated breaking areas may be engaged onto the forward portion of the tubular body, to protect the projectile during storage and handling. At the firing, the hood is broken up at the rated areas.

To avoid damages to the sabot of plastic material at certain discharge accelerations and certain wall thicknesses of the tubular projectile body, the sabot includes an end portion which carries a metallic intermediate ring comprising a collar which fits the sabot and is axially spaced from the rear face of the rear portion of the tubular projectile body. The intermediate ring is firmly connected to an extension of the sabot by a force fit. The metallic intermediate ring thus forms a buffer which is connected to the extension or forward portion of the sabot.

Accordingly, it is an object of the invention to provide an improved projectile which has a tubular projectile body and a rear portion and including an impact base having a forward portion connected to the rear portion which has an exterior surface with an annular groove in which a rotating band is positioned, the rear portion of the tubular body and the impact base being of a size and shape conformable to each other which permit interengagement and with further including means for positively locking the base to the projectile body.

A further object of the invention is to provide a projectile which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accommodating drawings and descriptive matter in which preferred embodiments of the invention are illustrated.

DESCRIPTION OF THE PREFERRED EMBODIMENTS

Figure 1:
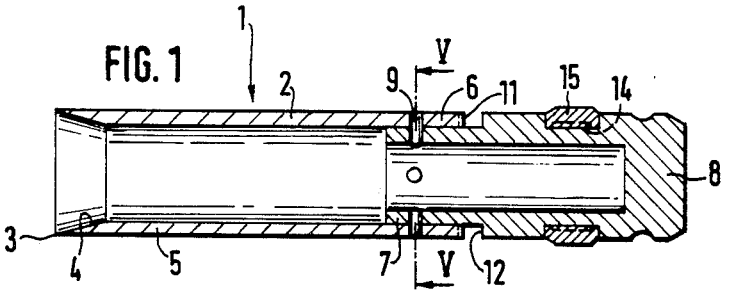
FIG. 1 is a sectional view of a projectile having a tubular body and equipped with a sabot.

Referring to the drawings in particular the invention embodied therein a comprises a projectile which has a tubular projectile body generally designated 1 and has a rear portion 6 including an impact base or sabot 8 connected to the body 2 at its rear portion 6 which has an annular groove 14 with a rotating band 15 therein. Means 9 in the form of shearing pins provide a positive locking of the base to the projectile body.

The inventive projectile 1 comprises a tubular body 2 which, except for its front end portion, is cylindrical over its entire length, i.e. has a constant wall thickness. The invention covers also other tubular bodies. At the front end, the inside diameter of the body diminishes from a frontal bite edge 3 over a slight taper 4 to a continuous inner bore 5. The rear portion 6 having a constant inside diameter of tubular body 2 is fitted over a correspondingly shaped forward portion 7 of the sabot 8. These two parts are connected to each other by pins 9 which are radially inserted in aligned bores 10 of tubular body 2 and sabot 8. Prior to a discharge (FIG. 1), the distance between the rear face 11 of the tubular body and a circular shoulder 12 of the sabot is equal to, or larger than, the diameter of pins 9. The rear face 11 is provided with corrugations 13 of some shape, such as teeth, knurling, milling, etc.

The rear portion of the sabot is provided with the annular groove 14 for receiving the rotating band 15. At the discharge of projectile 1, the pins 9 which are uniformly distributed over the circumference, are sheared off.

Figure 2:
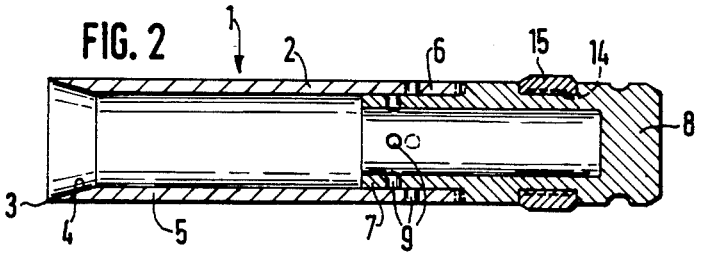
FIG. 2 is a similar view of the projectile after the discharge.

Due to the high acceleration within the barrel, tubular body 2 of the projectile impinges by its rear face 11 against circular shoulder 12 of the sabot and digs by its corrugation 13 into shoulder 12 which is of a softer material than projectile body 2 (FIG. 2). The spin imparted to sabot 8 is thereby transferred to tubular projectile body 2. With a small depth and sharpness of the corrugation, the shoulder of the sabot slips through and the spin is transferred only partly. This partial compensation for the rotation is advantageous since the spin of the projectile body is critical for the ballistic conditions.

Figure 3:
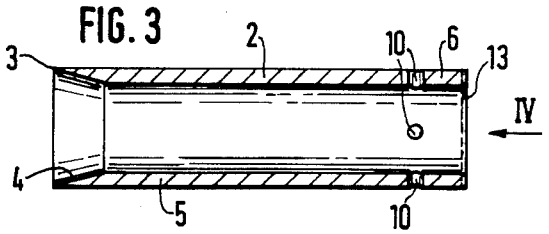
FIG. 3 shows a projectile of FIG. 1 after detachment from the sabot.
Figure 4:
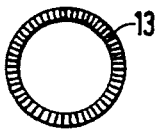
FIG. 4 is a view of the rear of the projectile taken in the direction of arrow IV in FIG. 3.
Figure 5:
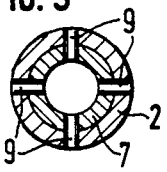
FIG. 5 is a sectional view of the projectile taken along line V—V of FIG. 1.

Upon leaving the barrel, sabot 8 is detached from tubular shell body 2, because of the produced dynamic pressure, so that the projectile body alone continues to follow the trajectory (FIG. 3).

In another embodiment of the invention, which is dependent on the rifling, no spacing of rear face 11 of rear portion 6 of body 2 from sabot shoulder 13 is provided. Pins 9 are then sheared off by the rotary acceleration.

Figure 6:
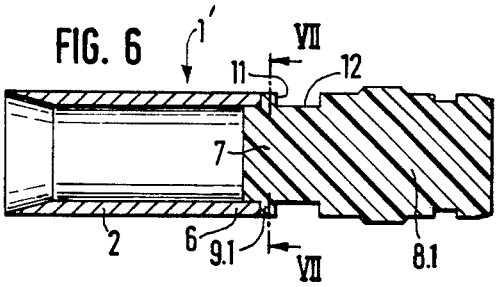
FIG. 6 is a sectional view of another embodiment of the projectile with a tubular body.
Figure 7:
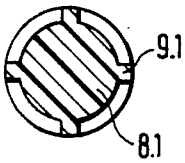
FIG. 7 is a sectional view taken along the line VII—VII of FIG. 6.

FIGS. 6 and 7 show a projectile 1' which has a tubular body 2 and is connected to a sabot 8.1 of plastic, having integral radially projecting pins 9.1. Rear face 11 of tubular body 2 applies against pins 9.1 and extends beyond them. The pins might also be received in bores. Here again, as in the embodiments of FIGS. 1 to 5, the rear face 11 of the tubular body 2 is spaced from the circular shoulder 13 by a distance equal to or exceeding the diameter of pins 9.1.

Figure 8:
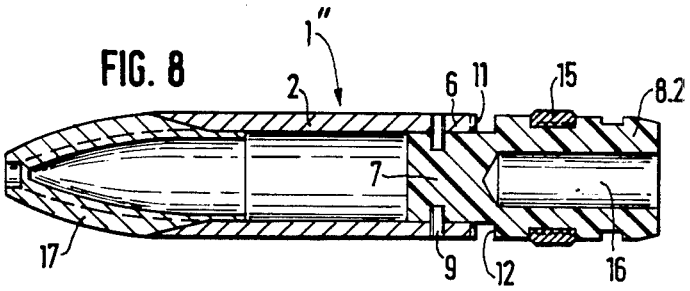
FIG. 8 is a sectional view of still another embodiment of a projectile with a hood fitted thereon.

According to FIG. 8, the rear end 8.2 of the sabot 8.2 of projectile 1'' is provided with a blind bore 16 permitting augmentation of the charge and reduction of the masses to be accelerated. A hood or ogive 17 with rated breaking lines is fitted onto the front end of tubular body 2, which is an effective protection of the projectile for storage and handling.

Figure 9:
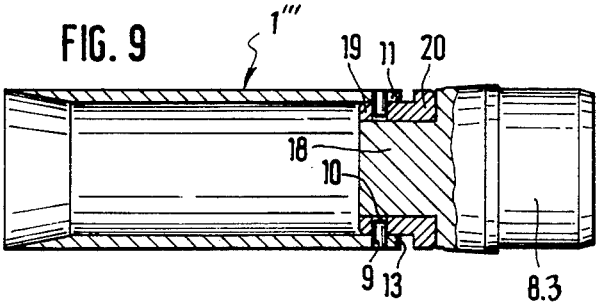
FIG. 9 shows a projectile with a tubular body and a metallic intermediate ring.

FIG. 9 shows a tubular projectile comprising a body 2 and sabot 8.3 with a metallic intermediate ring 19 having a collar 20 being engaged on a stud portion 18 of sabot 8.3. Intermediate ring 19 must be firmly connected to sabot 8.3, which may be effected by press-fitting, direct injection molding of a plastic thereon, or by means of an adhesive, a thread, etc. Intermediate ring 19 forms a buffer between body 2 and sabot 8.3 of plastic. Pins 9 are inserted in bores 10 provided in body 2 and in intermediate ring 19. The face 11 of rear portion 6 of tubular body 2 is also provided with a corrugation 13. After shearing off pins 9, rear face 11 impinges on collar 20 of intermediate ring 19.

While specific embodiments of the invention have been shown and described in detail to illustrate the application of the principles of the invention, it will be understood that the invention may be embodied otherwise without departing from such principles.

What is claimed is:

1. A projectile comprising a tubular projectile body having a rear portion with a bottom face, a sabot having a forward portion connected to said rear portion and having an exterior surface with an annular groove, a rotating band inserted in said annular groove, said rear portion of said projectile body being of a size and shape conformable to the forward portion of said sabot and being engaged one within the other, and a plurality of uniformly circumferentially distributed radial pins connecting said tubular body rear portion to said sabot forward portion, said sabot forward portion being inserted into said rear portion of said projectile body and including a raised exterior wall portion defining a shoulder, said rear portion of said body terminating in said bottom face spaced from said shoulder by a distance at least equal to a diameter of said pins connected between said sabot and said projectile body, said bottom face of said tubular body having corrugations facing said shoulder for forming an engagement with said shoulder of said sabot after said pins are sheared to impart spin of said sabot at least partly to said tubular projectile body, said rear portion having an outer diameter corresponding to an outer diameter of said shoulder, said projectile body being made of material which is harder than that of said sabot and said corrugations being selected to have at least one of a depth and an edge sharpness for permitting at least some slippage between a spin of said sabot and an imparted spin of said tubular body.

2. A projectile according to claim 1, wherein said sabot opens toward said projectile body, the opening comprising a blind bore.

* * * * *